US011328647B2

(12) United States Patent
Hong et al.

(10) Patent No.: US 11,328,647 B2
(45) Date of Patent: May 10, 2022

(54) DISPLAY DEVICE

(71) Applicant: Samsung Display Co., Ltd., Yongin-Si (KR)

(72) Inventors: Seokha Hong, Seoul (KR); Bonghyun You, Seoul (KR); Hye-Sang Park, Cheonan-si (KR); Heechul Hwang, Seongnam-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/159,203

(22) Filed: Jan. 27, 2021

(65) Prior Publication Data

US 2021/0335187 A1 Oct. 28, 2021

(30) Foreign Application Priority Data

Apr. 22, 2020 (KR) ..... 10-2020-0048801

(51) Int. Cl.
*G09G 3/20* (2006.01)

(52) U.S. Cl.
CPC ..... *G09G 3/2003* (2013.01); *G09G 3/2074* (2013.01); *G09G 2300/0452* (2013.01)

(58) Field of Classification Search
CPC ..... G09G 3/2003; G09G 3/2074; G09G 2300/0452
See application file for complete search history.

(56) References Cited

U.S. PATENT DOCUMENTS

| | | | | |
|---|---|---|---|---|
| 9,071,721 | B1 * | 6/2015 | D'Amico | H04N 9/04515 |
| 10,388,680 | B2 * | 8/2019 | Zheng | G09G 3/20 |
| 10,586,511 | B2 * | 3/2020 | Yang | G09G 5/10 |
| 11,056,030 | B1 * | 7/2021 | Melakari | G09G 3/3648 |
| 11,087,701 | B1 * | 8/2021 | Chen | G02B 6/0046 |
| 11,107,402 | B2 * | 8/2021 | Zhu | H01L 27/3267 |
| 2011/0019036 | A1 * | 1/2011 | Okado | H04N 5/361 348/243 |
| 2015/0029208 | A1 * | 1/2015 | Kim | G09G 3/2092 345/590 |
| 2016/0078807 | A1 * | 3/2016 | Sun | G09G 3/3233 345/204 |

(Continued)

FOREIGN PATENT DOCUMENTS

| | | | | |
|---|---|---|---|---|
| EP | 3813044 | A1 * | 4/2021 | G09G 3/20 |
| KR | 10-0436356 | B1 | 6/2004 | |

(Continued)

*Primary Examiner* — Ricardo Osorio
(74) *Attorney, Agent, or Firm* — Innovation Counsel LLP

(57) ABSTRACT

A display device includes a display panel and an optical module disposed under the display panel. The display panel includes a first display region under which the optical module is disposed to overlap the first display region in a plan view, the first display region including transparent regions through which light for an operation of the optical module passes and first pixels having a first pixel structure and disposed between the transparent regions, a second display region in which second pixels having a second pixel structure are disposed, and a third display region disposed between the first display region and the second display region, third pixels having a third pixel structure being disposed in the third display region, only part of the third pixels being driven during a display operation.

26 Claims, 14 Drawing Sheets

(56) References Cited

U.S. PATENT DOCUMENTS

| | | | | |
|---|---|---|---|---|
| 2016/0085268 | A1* | 3/2016 | Aurongzeb | G06F 1/1652 345/156 |
| 2016/0120005 | A1* | 4/2016 | Wu | H05B 33/26 313/505 |
| 2018/0012566 | A1* | 1/2018 | Lin | G09G 5/10 |
| 2018/0374426 | A1* | 12/2018 | Chen | G09G 3/3291 |
| 2019/0056815 | A1* | 2/2019 | Fan | G06F 3/0448 |
| 2019/0164521 | A1* | 5/2019 | Feng | G09G 3/3208 |
| 2019/0326366 | A1* | 10/2019 | Fan | H01L 27/3218 |
| 2019/0340974 | A1* | 11/2019 | Ka | G09G 3/3233 |
| 2020/0034100 | A1* | 1/2020 | Fan | G09G 3/3225 |
| 2020/0052059 | A1* | 2/2020 | Chen | H01L 27/3244 |
| 2020/0234634 | A1* | 7/2020 | Li | G09G 3/3233 |
| 2020/0335023 | A1* | 10/2020 | Yen | G09G 3/20 |
| 2020/0394959 | A1* | 12/2020 | Lou | G09G 3/3266 |
| 2021/0013277 | A1* | 1/2021 | Liu | H01L 27/3218 |
| 2021/0043135 | A1* | 2/2021 | Zhao | G09G 3/3275 |

FOREIGN PATENT DOCUMENTS

| | | | |
|---|---|---|---|
| KR | 10-2017-0113066 | A | 10/2017 |
| KR | 10-2019-0091576 | A | 8/2019 |

* cited by examiner

DISPLAY DEVICE

CROSS-REFERENCE TO RELATED APPLICATION

This application claims priority under 35 USC § 119 to Korean Patent Application No. 10-2020-0048801 filed on Apr. 22, 2020 in the Korean Intellectual Property Office (KIPO), the entire disclosure of which is incorporated herein by reference.

BACKGROUND

1. Field

Embodiments relate generally to a display device. More particularly, embodiments of the present inventive concept relate to a display device including a display panel that includes a transparent display region and a non-transparent display region adjacent to the transparent display region.

2. Description of the Related Art

Recently, a display device including a display panel having a transparent display region and a non-transparent display region disposed adjacent to the transparent display region is being mounted on the electronic device. In general, the display panel included in the display device may include a transparent display region configured to allow light for an operation of an optical module to pass therethrough and configured to display an image, and a non-transparent display region (or referred to as an opaque display region) configured to perform image display only. In this case, since the optical module is disposed to overlap the transparent display region, the transparent display region may include transparent regions through which the light for the operation of the optical module passes, and pixels disposed between the transparent regions and configured to display an image. Meanwhile, the non-transparent display region may not include the transparent regions but only include pixel displaying an image. Therefore, a pixel density of the non-transparent display region may be greater than a pixel density of the transparent display region. Accordingly, when an image is displayed on the display panel, a boundary between the non-transparent display region and the transparent display region may be recognized by a user due to a difference in luminance between the non-transparent display region and the transparent display region. In addition, when luminance of each of the pixels included in the transparent display region is increased for the driving in order to reduce the difference in luminance between the non-transparent display region and the transparent display region, deterioration of the pixels included in the transparent display region may proceed relatively rapidly over time, so that the boundary between the non-transparent display region and the transparent display region may become more apparent. Therefore, there is a demand for a display panel in which the boundary between the non-transparent display region and the transparent display region may not be recognized by the user while the display panel operates in a manner that does not cause the deterioration of the pixels included in the transparent display region.

SUMMARY

Embodiments provide a display device including a display panel capable of minimizing (or reducing) user recognition of a boundary between a non-transparent display region and a transparent display region while the display panel operates in a manner that does not cause deterioration of pixels included in the transparent display region.

According to embodiments, a display device may include a display panel and an optical module disposed to overlap the display panel. Here, the display panel may include a first display region under which the optical module is disposed to overlap the first display region in a plan view, the first display region including transparent regions through which light for an operation of the optical module passes and first pixels having a first pixel structure and disposed between the transparent regions, a second display region in which second pixels having a second pixel structure are disposed, and a third display region disposed between the first display region and the second display region, third pixels having a third pixel structure being disposed in the third display region, only part of the third pixels being driven during a display operation.

In embodiments, the first pixel structure, the second pixel structure, and the third pixel structure may be identical to each other.

In embodiments, one of the first pixel structure, the second pixel structure, and the third pixel structure may be different from the others.

In embodiments, the first pixel structure may be an RGB structure, and each of the second pixel structure and the third pixel structure may be a PenTile structure.

In embodiments, the first display region may be surrounded by the third display region, and the third display region may be surrounded by the second display region.

In embodiments, the third display region may include first to kth sub-intermediate display regions, where k is an integer greater than or equal to 2, the first sub-intermediate display region may be disposed adjacent to the first display region, the kth sub-intermediate display region may be disposed adjacent to the second display region, and a driving pixel density of an mth sub-intermediate display region may be lower than a driving pixel density of an (m+1)th sub-intermediate display region during the display operation, where m is an integer greater than or equal to 1 and smaller than k.

In embodiments, the part of the third pixels driven in the third display region during the display operation may be selected symmetrically with respect to a horizontal axis and a vertical axis passing through a center of the first display region.

In embodiments, the part of the third pixels driven in the third display region during the display operation may be selected asymmetrically with respect to a horizontal axis or a vertical axis passing through a center of the first display region.

In embodiments, the part of the third pixels driven in the third display region during the display operation may be altered every frame.

In embodiments, the part of the third pixels driven in the third display region during the display operation may be selected in a preset fixed pattern.

In embodiments, the first to kth sub-intermediate display regions may have a same width.

In embodiments, at least one of the first to $k^{th}$ sub-intermediate display regions may have a different width than the other intermediate display regions.

According to embodiments, a display device may include a display panel and an optical module disposed under the display panel to overlap the display panel in a plan view. Here, the display panel may include a first display region under which the optical module is disposed to overlap the display panel in a plan view, the first display region including first transparent regions through which light for an operation of the optical module passes, and first pixels having a first pixel structure and disposed between the first transparent regions, a second display region in which second pixels having a second pixel structure are disposed, and a third display region disposed between the first display region and the second display region, the optical module being disposed under the third display region to overlap the third display region in a plan view, the third display region including second transparent regions through which the light passes, and third pixels having a third pixel structure and disposed between the second transparent regions.

In embodiments, the first pixel structure, the second pixel structure, and the third pixel structure may be identical to each other.

In embodiments, one of the first pixel structure, the second pixel structure, and the third pixel structure may be different from the others.

In embodiments, the first pixel structure may be an RGB structure, and each of the second pixel structure and the third pixel structure may be a PenTile structure.

In embodiments, the first display region may be surrounded by the third display region and the third display region may be surrounded by the second display region.

In embodiments, the third display region may include first to kth sub-intermediate display regions, where k is an integer greater than or equal to 2, the first sub-intermediate display region may be disposed adjacent to the first display region, the kth sub-intermediate display region may be disposed adjacent to the second display region, and a pixel density of an mth sub-intermediate display region may be lower than a pixel density of an (m+1)th sub-intermediate display region, where m is an integer greater than or equal to 1 and smaller than k.

In embodiments, the third pixels in the third display region may be disposed symmetrically with respect to a horizontal axis and a vertical axis passing through a center of the first display region.

In embodiments, the third pixels in the third display region may be disposed asymmetrically with respect to a horizontal axis or a vertical axis passing through a center of the first display region.

In embodiments, the first to kth sub-intermediate display regions may have a same width.

In embodiments, at least one of the first to kth sub-intermediate display regions may have a different width than the other intermediate display regions.

According to embodiments, a display panel may include a transparent display region including pixels disposed between adjacent first transparent areas, an intermediate display region surrounding the transparent display region and including pixels disposed between adjacent second transparent areas, and a non-transparent display region surrounding the intermediate display region. An area ratio of the second transparent areas in the intermediate display region may be less than that of the first transparent areas in the transparent display region.

In embodiments, the intermediate display region includes sub-intermediate display regions having different area ratios of the second transparent areas.

In embodiments, a sub-intermediate display region disposed adjacent to the transparent display region may have an area ratio of the second transparent areas greater than that of a sub-intermediate display region disposed adjacent to the non-transparent display region.

In embodiments, an area of each of the first transparent areas may be greater than an area of each of the second transparent areas.

In embodiments, the transparent display region may have a different pixel structure than the intermediated display region and the non-transparent display region In embodiments, the transparent display region may have an RGB structure and the intermediated display region and the non-transparent display region have a PenTile structure.

Therefore, a display device according to embodiments may include a display panel including a transparent display region under which an optical module is located to overlap the transparent display region, the transparent display region including transparent regions through which light for an operation of the optical module passes, and first pixels having a first pixel structure being disposed between the transparent regions, a non-transparent display region in which second pixels having a second pixel structure are disposed, and an intermediate display region located between the transparent display region and the non-transparent display region, third pixels having a third pixel structure being disposed in the intermediate display region. Here, when driving only some of the third pixels included in the intermediate display region during a display operation, the display panel may perform a gradual driving masking in which a driving pixel density of the intermediate display region gradually increases from the transparent display region to the non-transparent display region. Accordingly, user recognition of a boundary between the non-transparent display region and the transparent display region can be minimized through the gradual driving masking while the display panel operates in a manner that does not cause deterioration of the first pixels included in the transparent display region (i.e., it is unnecessary to perform the driving for intentionally increasing luminance of each of the first pixels included in the transparent display region).

In addition, a display device according to embodiments may include a display panel including a transparent display region under which an optical module is disposed to overlap the transparent display region, the transparent display region including first transparent regions through which light for an operation of the optical module passes, and first pixels having a first pixel structure being disposed between the first transparent regions, a non-transparent display region in which second pixels having a second pixel structure are disposed, and an intermediate display region located between the transparent display region and the non-transparent display region, the optical module being located under the intermediate display region to overlap the intermediate display region, the intermediate display region including second transparent regions through which the light passes, and third pixels having a third pixel structure being disposed between the second transparent regions.

Here, the display panel may have a pixel structure in which a pixel density of the intermediate display region gradually increases from the transparent display region to the non-transparent display region. Accordingly, user recognition of a boundary between the non-transparent display region and the transparent display region can be minimized through the gradual design structure while the display panel operates in a manner that does not cause deterioration of the first pixels included in the transparent display region (i.e., it is unnecessary to perform the driving for intentionally increasing luminance of each of the first pixels included in the transparent display region). However, the effects of the present inventive concept are not limited thereto. Thus, the effects of the present inventive concept may be extended without departing from the spirit and the scope of the present inventive concept.

BRIEF DESCRIPTION OF THE DRAWINGS

Illustrative, non-limiting embodiments will be more clearly understood from the following detailed description in conjunction with the accompanying drawings.

DETAILED DESCRIPTION OF THE EMBODIMENTS

Hereinafter, embodiments of the present inventive concept will be explained in detail with reference to the accompanying drawings.

Figure 1:
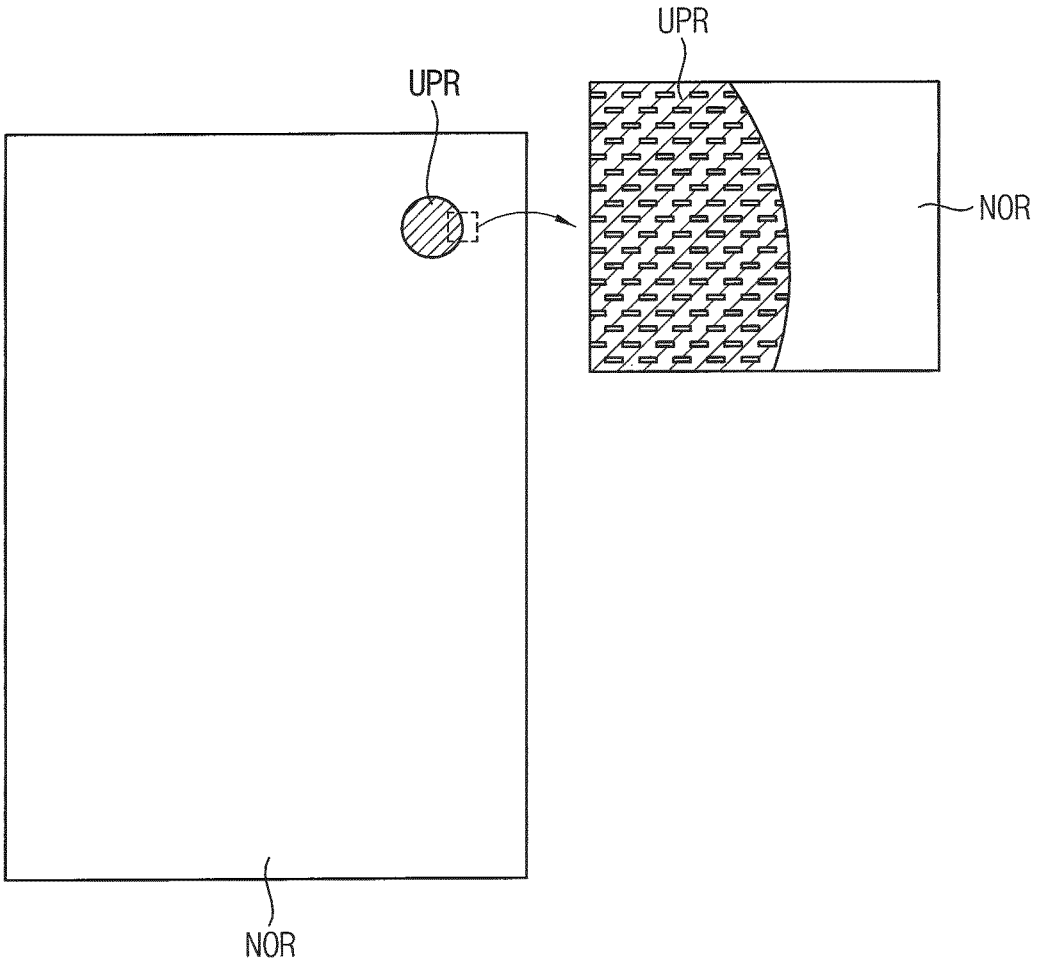
FIG. 1 (PRIOR ART)
FIG. 1 is a diagram illustrating a conventional display panel.

FIG. 1 is a diagram illustrating a conventional display panel.

Referring to FIG. 1, a conventional display panel may include a transparent display region UPR in which first pixels having a first pixel structure are disposed, and a non-transparent display region NOR in which second pixels having a second pixel structure are disposed. In one embodiment, the first pixel structure and the second pixel structure may be identical to each other. In another embodiment, the first pixel structure and the second pixel structure may be different from each other. For example, the first pixels disposed in the transparent display region UPR may have an RGB structure. For example, each of the first pixels may include a red sub-pixel, a green sub-pixel, and a blue sub-pixel. For example, the second pixels disposed in the non-transparent display region NOR may have a PenTile structure. For example, each of the second pixels may include a red sub-pixel and a green sub-pixel, or a blue sub-pixel and a green sub-pixel. However, the above configuration is proposed for illustrative purposes, so the structure of the pixel is not limited thereto. Meanwhile, an optical module may be disposed under the transparent display region UPR to overlap the transparent display region UPR. Therefore, light for an operation of the optical module may pass through the transparent display region UPR and incident onto the optical module. In other words, since transparent regions are disposed in portions of the transparent display region UPR except for regions for the first pixels, the transparent display region UPR may have a lower pixel density than the non-transparent display region NOR in which the transparent regions are not disposed. As a result, when an image is displayed on the conventional display panel, a boundary between the non-transparent display region NOR and the transparent display region UPR may be recognized by a user due to a difference in luminance caused by a difference in pixel densities between the non-transparent display region NOR and the transparent display region UPR. In addition, when luminance of each of the first pixels included in the transparent display region UPR is increased to reduce the difference in luminance between the non-transparent display region NOR and the transparent display region UPR, deterioration of the first pixels included in the transparent display region UPR may proceed faster than deterioration of the second pixels included in the non-transparent display region NOR over time, so that the boundary between the non-transparent display region NOR and the transparent display region UPR may become more apparent. Therefore, a display panel according to embodiments of the present invention may have an intermediate display region disposed between the transparent display region UPR and the non-transparent display region NOR. The intermediate display region may include transparent regions. A gradual driving masking is performed on the intermediate display region when the intermediate display region does not have transparent regions. Thus, the intermediated display region may have a luminance less than that of the non-transparent display region NOR and greater than that of the transparent display region UPR. Accordingly, user may not recognize a boundary between the non-transparent display region NOR and the transparent display region UPR even when the transparent display region UPR is not driven to have an increased luminance, thus the first pixels included in the transparent display region UPR may not be deteriorated faster than the second pixels included in the non-transparent display region NOR.

Figure 2A:
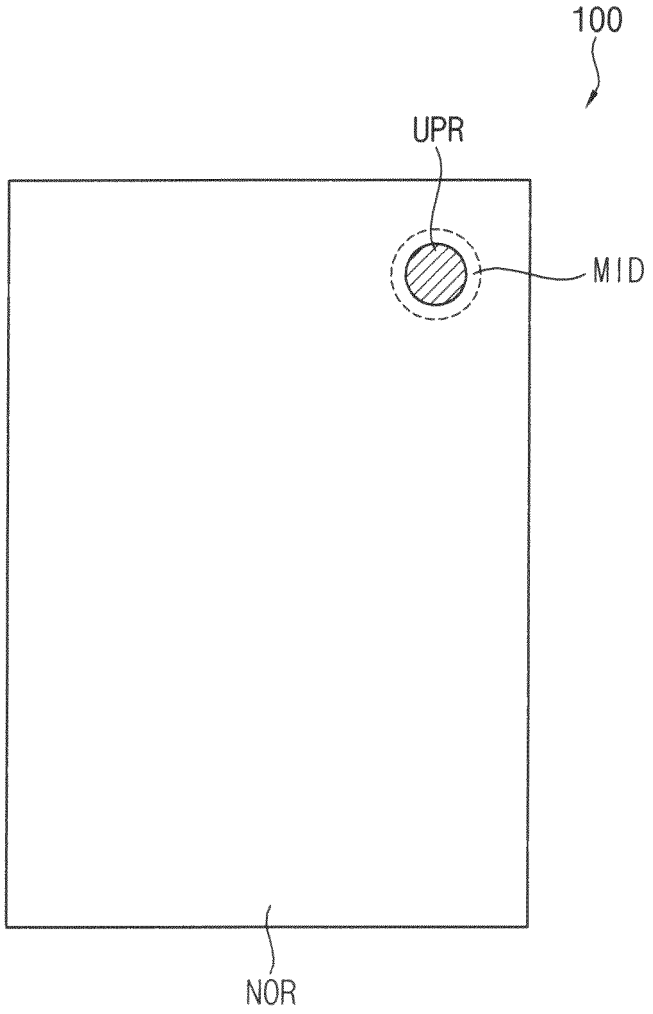
FIG. 2A is a diagram illustrating a display panel according to embodiments.
Figure 2B:
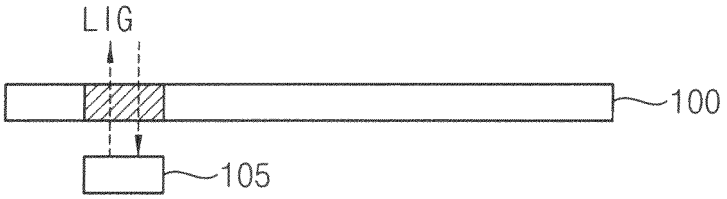
FIG. 2B is a diagram illustrating an example in which an optical module is disposed under the display panel of FIG. 2A.
Figure 3:
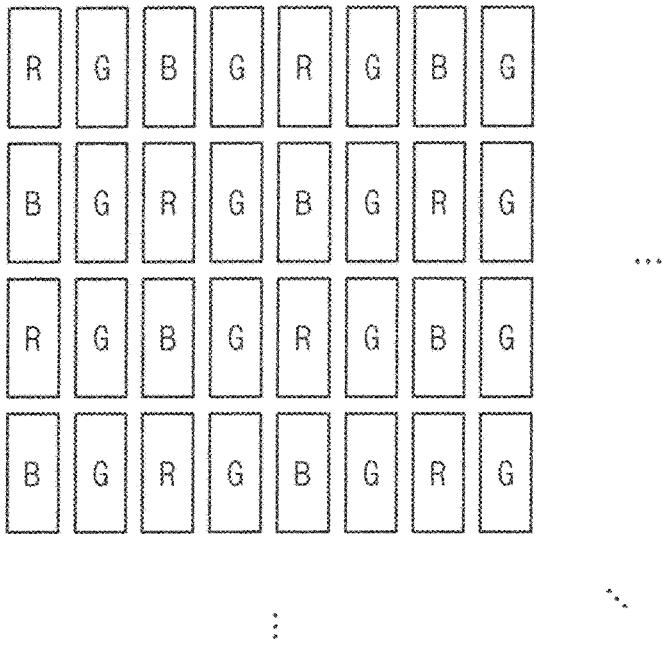
FIG. 3 is a diagram illustrating an example of a structure of a non-transparent display region and an intermediate display region included in the display panel of FIG. 2A.
Figure 4:
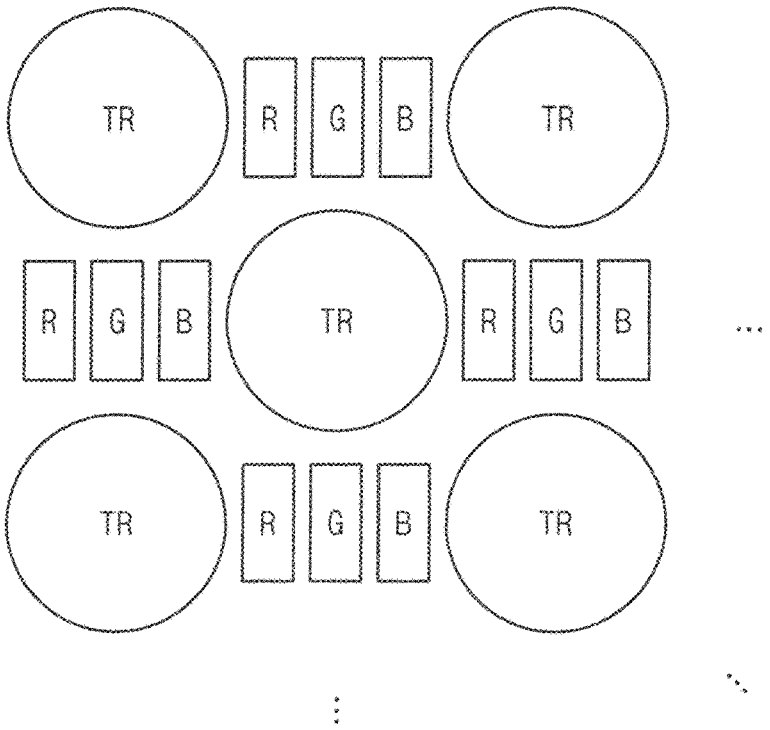
FIG. 4 is a diagram illustrating an example of a structure of a transparent display region included in the display panel of FIG. 2A.
Figure 5A:
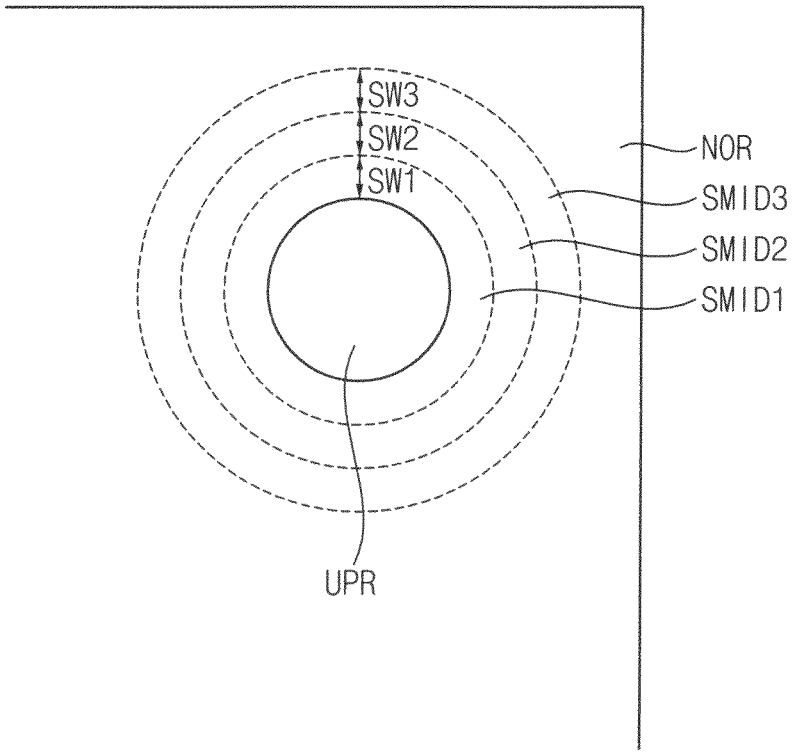
FIGS. 5A and 5B are diagrams for describing driving pixels that are driven during a display operation in the display panel of FIG. 2A.
Figure 5B:
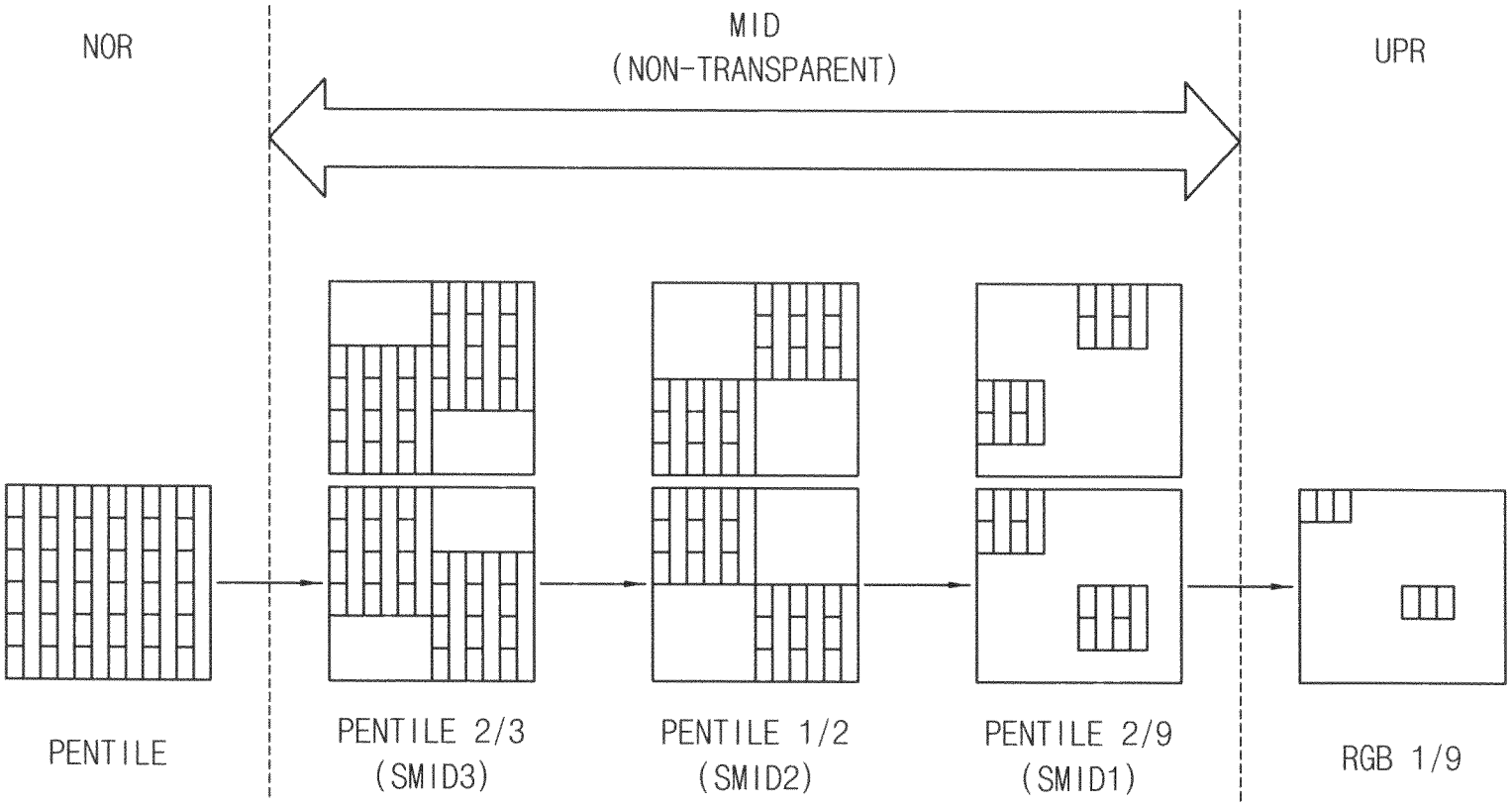

FIG. 2A is a diagram illustrating a display panel according to embodiments, FIG. 2B is a diagram illustrating an example in which an optical module is disposed under the display panel of FIG. 2A, FIG. 3 is a diagram illustrating an example of a structure of a non-transparent display region and an intermediate display region included in the display panel of FIG. 2A, FIG. 4 is a diagram illustrating an example of a structure of a transparent display region included in the display panel of FIG. 2A, and FIGS. 5A and 5B are diagrams for describing driving pixels that are driven during a display operation in the display panel of FIG. 2A.

Referring to FIGS. 2A to 5B, a display panel 100 may include a transparent display region UPR (or referred to as a first display region), a non-transparent display region NOR (or referred to as a second display region), and an intermediate display region MID (or referred to as a third display region) disposed between the transparent display region UPR and the non-transparent display region NOR.

As shown in FIGS. 2A and 2B, the transparent display region UPR may be configured such that an optical module 105 is disposed under the transparent display region UPR to overlap the transparent display region UPR, and may include transparent regions TR through which light LIG for an operation of the optical module 105 passes. In this case, the transparent region TR may be defined as a region in which pixels are not disposed. For example, pixels and/or conductive wires that supply signals to the pixels may not be disposed in the transparent region TR. In some embodiments, a common electrode (cathode) and/or an insulating layer of an organic light emitting diode may be removed from the transparent region TR so that the transparent region TR may have a high transmittance. For example, the optical module 105 may include: a proximity sensor module for detecting proximity of a predetermined object with respect to a front surface of the display panel 100; an illuminance sensor module for detecting illuminance on the front surface of the display panel 100; an iris recognition sensor module for recognizing an iris of a user; a camera module for capturing a still image and/or a moving image; and the like. First pixels having a first pixel structure may be disposed between the transparent regions TR in the transparent display region UPR. For example, as shown in FIG. 4, the first pixels disposed in the transparent display region UPR may have an RGB structure. For example, each of the first pixels may include a red sub-pixel R, a green sub-pixel G, and a blue sub-pixel B. Since the optical module 105 is disposed under the transparent display region UPR to overlap the transparent display region UPR, the light LIG for the operation of the optical module 105 may pass through the transparent display region UPR. To this end, as shown in FIG. 4, the transparent display region UPR may include transparent regions TR disposed between the first pixels. Although the transparent region TR has been shown in FIG. 4 as having a circular shape, the above shape is proposed for illustrative purposes, and the transparent region TR may have various shapes (e.g., a rectangular shape). As described above, since the transparent display region UPR includes the transparent regions TR, the transparent display region UPR may have a lower pixel density (a lower resolution) than the non-transparent display region NOR that does not include transparent regions. In some embodiments, in order to relatively increase luminance of each of the first pixels included in the transparent display region UPR, a size of each of the first pixels included in the transparent display region UPR may be increased to have a size larger than a size of each of second pixels included in the non-transparent display region NOR and/or a size of each of the third pixels included in the intermediate display region MID.

Second pixels having a second pixel structure may be disposed in the non-transparent display region NOR. For example, as shown in FIG. 3, the second pixels disposed in the non-transparent display region NOR may have a PenTile structure. For example, each of the second pixels may include a red sub-pixel R and a green sub-pixel G, or a blue sub-pixel B and a green sub-pixel G. However, the above configuration is proposed for illustrative purposes, so the pixel structure is not limited thereto. Meanwhile, all of the second pixels included in the non-transparent display region NOR may be driven during a display operation of the display panel 100. In other words, all of the second pixels included in the non-transparent display region NOR may be driven according to data signals applied to the second pixels. As described above, since the non-transparent display region NOR does not include transparent regions, the non-transparent display region NOR may have a higher pixel density than the transparent display region UPR in which some of the pixel regions are replaced by the transparent regions TR. As a result, under the same conditions (e.g., application of the same data voltage, etc.), luminance of the non-transparent display region NOR may be higher than luminance of the transparent display region UPR. Accordingly, when the intermediate display region MID does not exist, a boundary between the non-transparent display region NOR and the transparent display region UPR may be recognized by a user due to a difference in luminance between the non-transparent display region NOR and the transparent display region UPR.

The intermediate display region MID may be disposed between the transparent display region UPR and the non-transparent display region NOR. Third pixels having a third pixel structure may be disposed in the intermediate display region MID. In one embodiment, the first pixel structure, the second pixel structure, and the third pixel structure may be identical to each other. In another embodiment, at least one of the first pixel structure, the second pixel structure, and the third pixel structure may be different from the others. For example, as shown in FIG. 3, the third pixels disposed in the intermediate display region MID may have a PenTile structure. For example, each of the third pixels may include a red sub-pixel R and a green sub-pixel G, or a blue sub-pixel B and a green sub-pixel G. However, the above configuration is proposed for illustrative purposes, so the pixel structure is not limited thereto. Meanwhile, only part of the third pixels included in the intermediate display region MID may be driven during the display operation of the display panel 100. In other words, only some of the third pixels included in the intermediate display region NOR may emit light during the display operation of the display panel 100. In one embodiment, as shown in FIG. 2A, the transparent display region UPR may be surrounded by the intermediate display region MID, and the intermediate display region MID may be surrounded by the non-transparent display region NOR. In this case, the intermediate display region MID and the transparent display region UPR may have the same shape. For example, as shown in FIG. 2A, when the transparent display region UPR has a circular shape, the intermediate display region MID surrounding the transparent display region UPR may have a circular shape with a circular empty space corresponding to the transparent display region UPR (i.e., a donut shape). As another example, when the transparent display region UPR has a square shape, the intermediate display region MID surrounding the transparent display region UPR may have a square shape with a square empty space corresponding to the transparent display region UPR. As still another example, when the transparent display region UPR has a diamond shape, the intermediate display region MID surrounding the transparent display region UPR may have a diamond shape with a diamond-shaped empty space corresponding to the transparent display region UPR. In some embodiments, the transparent display region UPR, the intermediate display region MID, and the non-transparent display region NOR may be sequentially arranged in one direction (e.g., a bar type, etc.). However, for convenience of description, in the present disclosure, the following description will focus on an embodiment in which the transparent display region UPR is surrounded by the intermediate display region MID, and the intermediate display region MID is surrounded by the non-transparent display region NOR.

The display panel 100 may be driven to perform gradual driving masking in which a driving pixel density of the intermediate display region MID gradually increases from the transparent display region UPR to the non-transparent display region NOR by driving part of the third pixels disposed in the intermediate display region MID. In this case, the driving pixel density may be defined as number of driving pixels per unit area. In detail, the intermediate display region MID may include first to $k^{th}$ sub-intermediate display regions SMID1, . . . , and SMIDk, where k is an integer greater than or equal to 2, the first sub-intermediate display region SMID1 may be disposed adjacent to the transparent display region UPR, the $k^{th}$ sub-intermediate display region SMIDk may be disposed adjacent to the non-transparent display region NOR, and a driving pixel density of an $m^{th}$ sub-intermediate display region SMIDm may be lower than a driving pixel density of an $(m+1)^{th}$ sub-intermediate display region SMIDm+1 during the display operation of the display panel 100, where m is an integer greater than or equal to 1 and smaller than k. For example, the first to $k^{th}$ sub-intermediate display regions SMID1, . . . , and SMIDk may have the same pixel density but may have mutually different driving pixel densities. In one embodiment, as shown in FIG. 5A, the first to $k^{th}$ sub-intermediate display regions SMID1, . . . , and SMIDk may have the same widths SW1, SW2, and SW3. In another embodiment, two or more of the first to third sub-intermediate display regions SMID1, . . . , and SMIDk may have mutually different widths SW1, SW2, and SW3. For example, as shown in FIG. 5A, when the intermediate display region MID includes first to third sub-intermediate display regions SMID1, SMID2, and SMID3, the first sub-intermediate display region SMID1 may be disposed adjacent to the transparent display region UPR, and the third sub-intermediate display region SMID3 may be disposed adjacent to the non-transparent display region NOR. In this case, as shown in FIG. 5B, during the display operation of the display panel 100, a driving pixel density of the first sub-intermediate display region SMID1 may be lower than a driving pixel density of the second sub-intermediate display region SMID2, and the driving pixel density of the second sub-intermediate display region SMID2 may be lower than a driving pixel density of the third sub-intermediate display region SMID3. In other words, during the display operation of the display panel 100, the driving pixel density of the intermediate display region MID may gradually increase from the transparent display region UPR to the non-transparent display region NOR.

For example, as shown in FIG. 5B, since the transparent display region UPR includes the transparent regions TR, and the first pixels are disposed between the transparent regions TR, during the display operation of the display panel 100, all of the first pixels may be driven, but the transparent display region UPR may have the lowest driving pixel density (e.g., the transparent display region UPR may have a driving pixel density of 1/9). In this case, since the intermediate display region MID is a region configured to perform image display only, unlike the transparent display region UPR, the driving pixel density of the first sub-intermediate display region SMID1 surrounding the transparent display region UPR may be higher than a driving pixel density of the transparent display region UPR (e.g., the first sub-intermediate display region SMID1 may have a driving pixel density of 2/9). In addition, since the driving pixel density of the intermediate display region MID has to gradually increase from the transparent display region UPR to the non-transparent display region NOR, the driving pixel density of the second sub-intermediate display region SMID2 surrounding the first sub-intermediate display region SMID1 may be higher than the driving pixel density of the first sub-intermediate display region SMID1 (e.g., the second sub-intermediate display region SMID2 may have a driving pixel density of 1/2). Furthermore, since the driving pixel density of the intermediate display region MID has to gradually increase from the transparent display region UPR to the non-transparent display region NOR, the driving pixel density of the third sub-intermediate display region SMID3 surrounding the second sub-intermediate display region SMID2 may be higher than the driving pixel density of the second sub-intermediate display region SMID2 (e.g., the third sub-intermediate display region SMID3 may have a driving pixel density of 2/3). Meanwhile, since the non-transparent display region NOR is a region configured to perform image display only, a driving pixel density of the non-transparent display region NOR surrounding the third sub-intermediate display region SMID3 may be higher than the driving pixel density of the third sub-intermediate display region SMID3 (e.g., the non-transparent display region NOR may have a driving pixel density of 1/1). However, the above configuration is proposed for illustrative purposes, so the gradual driving masking according to the present invention is not limited thereto.

In one embodiment, during the display operation of the display panel 100, some of the third pixels driven in the intermediate display region MID may be selected symmetrically with respect to a horizontal axis and a vertical axis passing through a center of the transparent display region UPR. Because the intermediate display region MID surrounds the transparent display region UPR, a center of the intermediate display region MID may coincide with the center of the transparent display region UPR. Because some of the third pixels driven in the intermediate display region MID are selected symmetrically with respect to the horizontal axis and the vertical axis passing through the center of the intermediate display region MID, an image displayed in the intermediate display region MID may be prevented from being asymmetrically viewed. In another embodiment, during the display operation of the display panel 100, some of the third pixels driven in the intermediate display region MID may be selected asymmetrically with respect to the horizontal axis or the vertical axis passing through the center of the transparent display region UPR. Because the intermediate display region MID surrounds the transparent display region UPR, the center of the intermediate display region MID may coincide with the center of the transparent display region UPR. Because some of the third pixels driven in the intermediate display region MID are selected asymmetrically with respect to the horizontal axis or the vertical axis passing through the center of the intermediate display region MID, an image displayed in the intermediate display region MID may be asymmetrically viewed, but image quality may be improved in a specific image pattern. Meanwhile, in one embodiment, during the display operation of the display panel 100, some of the third pixels driven in the intermediate display region MID may be altered every frame. In this case, since driving pixels selected from the third pixels included in the intermediate display region MID are altered when the display panel 100 performs the gradual driving masking, deterioration of the third pixels included in the intermediate display region MID may be uniform, and a time division effect may be achieved in displaying an image. In another embodiment, during the display operation of the display panel 100, some of the third pixels driven in the intermediate display region MID may be selected to have a preset fixed pattern. In this case, since the driving pixels selected from the third pixels included in the intermediate display region MID are not changed when the display panel 100 performs the gradual driving masking, the gradual driving masking may be rapidly performed on the intermediate display region MID (i.e., there is no hardware and/or software burden for changing the driving pixels in the intermediate display region MID).

As described above, the display panel 100 may include: a transparent display region UPR in which an optical module 105 is disposed under the transparent display region UPR to overlap the transparent display region UPR, the transparent display region UPR includes transparent regions TR through which light LIG for an operation of the optical module 105 passes, and first pixels having a first pixel structure are disposed between the transparent regions TR; a non-transparent display region NOR in which second pixels having a second pixel structure are disposed; and an intermediate display region MID disposed between the transparent display region UPR and the non-transparent display region NOR, in which third pixels having a third pixel structure are disposed (where the intermediate display region MID actually corresponds to the non-transparent display region NOR because the intermediate display region MID does not include the transparent regions TR). In this case, while driving only part of the third pixels included in the intermediate display region MID during the display operation, the display panel 100 performs the gradual driving masking in which the driving pixel density of the intermediate display region MID gradually increases from the transparent display region UPR to the non-transparent display region NOR so that user may not recognize the boundary between the non-transparent display region NOR and the transparent display region UPR through the gradual driving masking while the display panel 100 operates in a manner that does not cause deterioration of the first pixels included in the transparent display region UPR (i.e., it is unnecessary to perform the driving for intentionally increasing luminance of each of the first pixels included in the transparent display region UPR). Meanwhile, although the above description has been focusing on the embodiment in which the transparent display region UPR is surrounded by the intermediate display region MID and the intermediate display region MID is surrounded by the non-transparent display region NOR, it should be understood that the present invention is not limited to the above embodiment. For example, the present invention may be applied to an embodiment in which the transparent display region UPR, the intermediate display region MID, and the non-transparent display region NOR are sequentially arranged in one direction.

Figure 6:
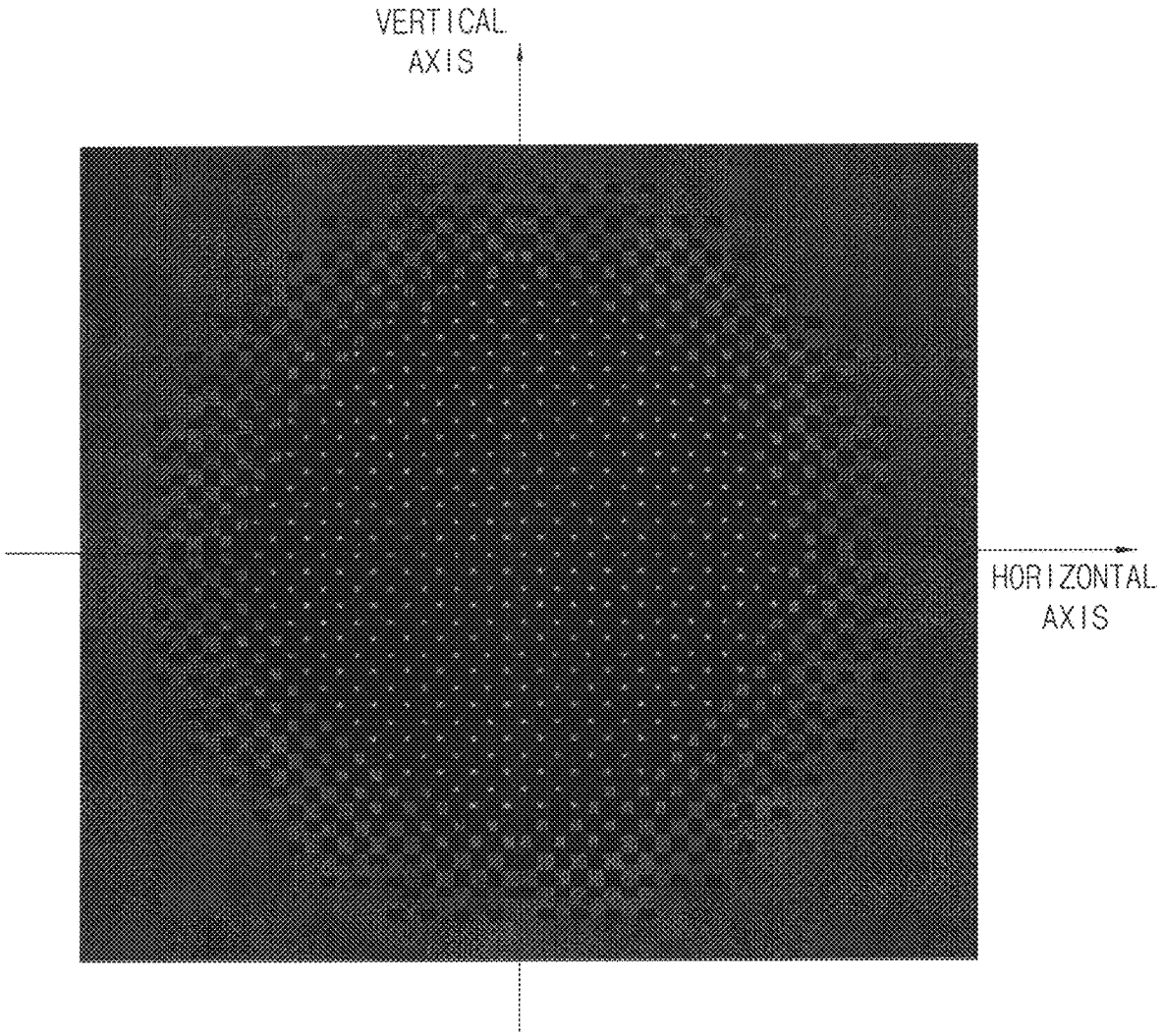
FIG. 6 is a diagram illustrating an example of driving pixels that are driven during a display operation in the display panel of FIG. 2A.
Figure 7:
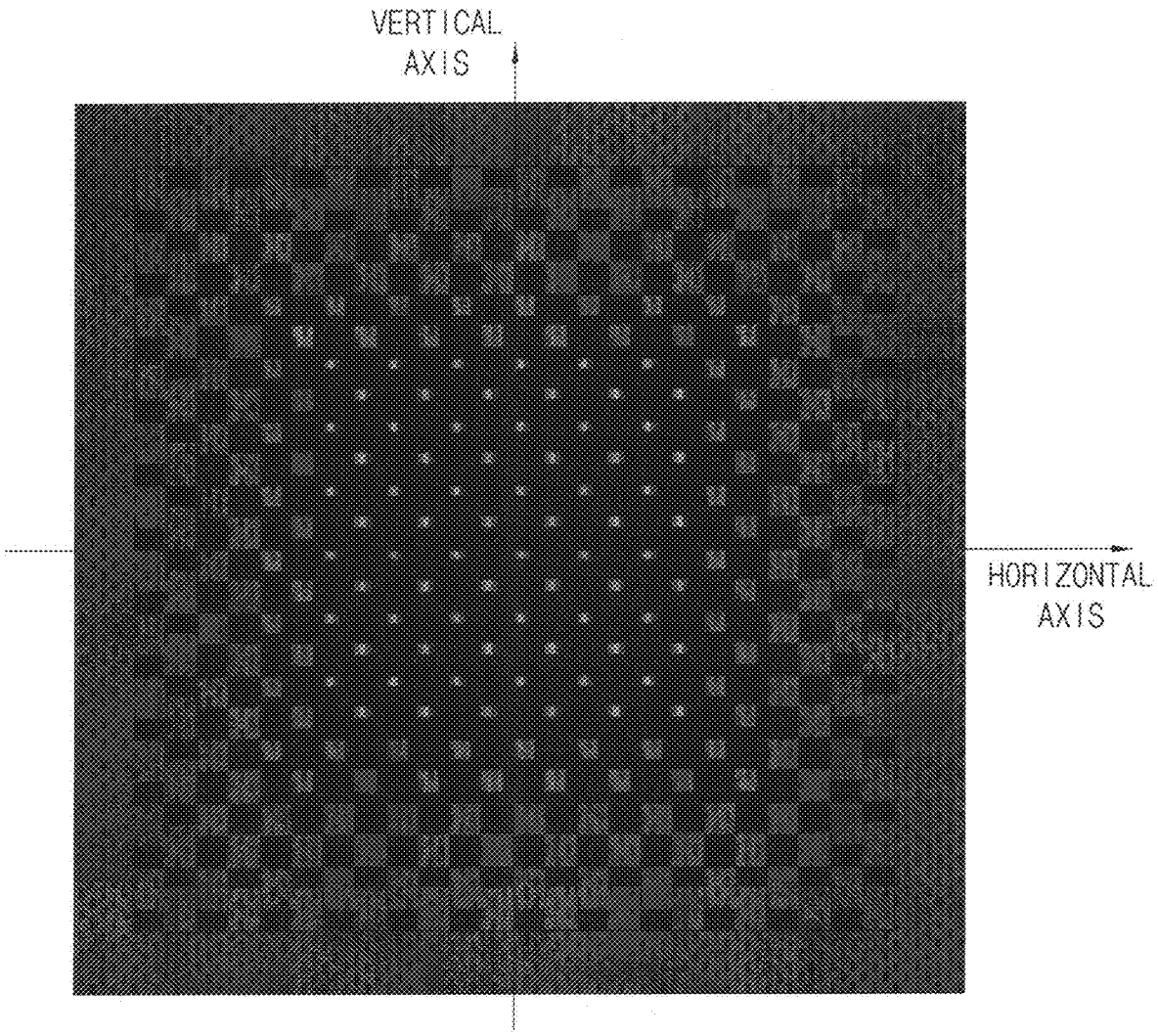
FIG. 7 is a diagram illustrating another example of driving pixels that are driven during a display operation in the display panel of FIG. 2A.
Figure 8:
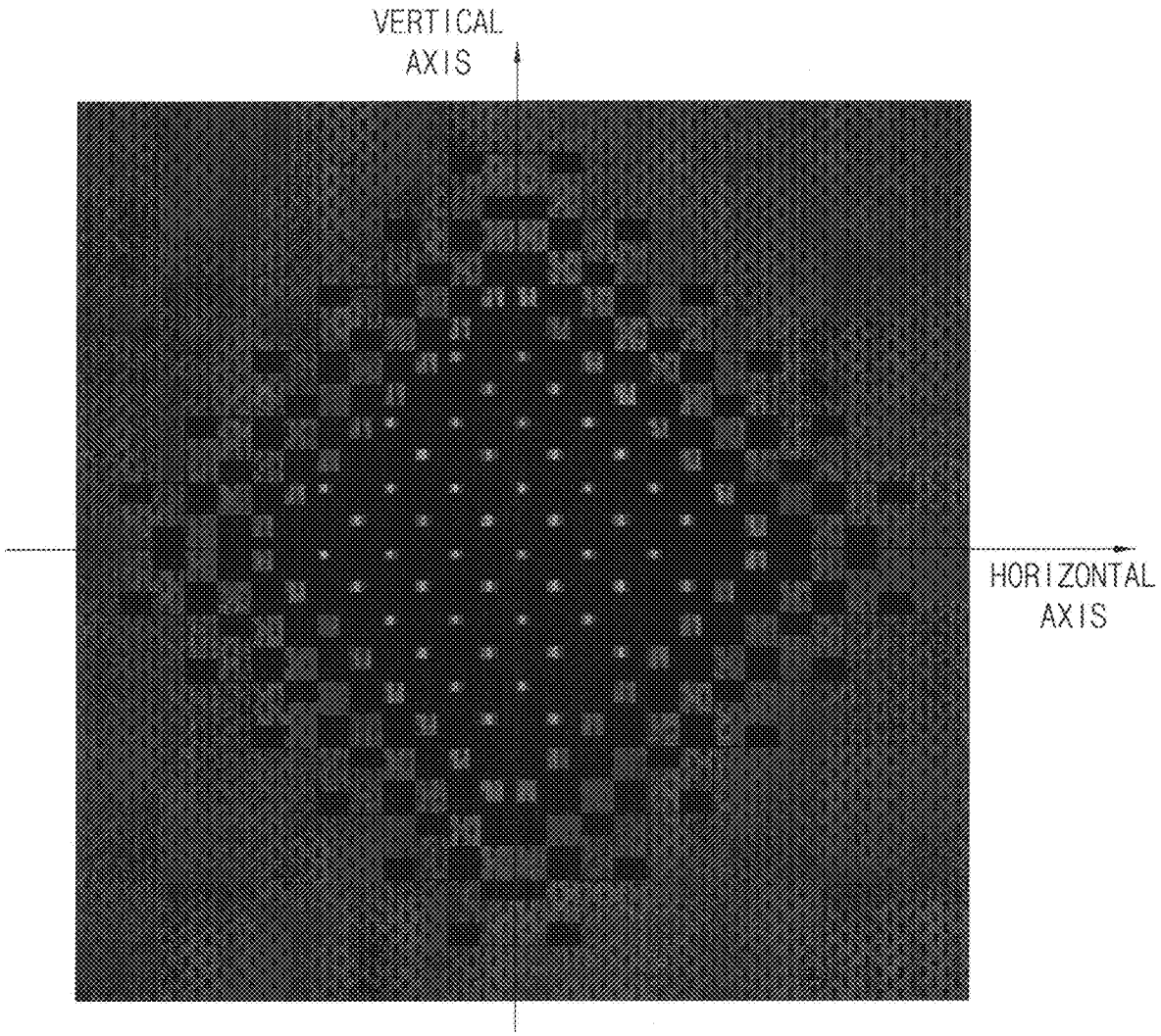
FIG. 8 is a diagram illustrating still another example of driving pixels that are driven during a display operation in the display panel of FIG. 2A.

FIG. 6 is a diagram illustrating an example of driving pixels that are driven during a display operation in the display panel of FIG. 2A, FIG. 7 is a diagram illustrating another example of driving pixels that are driven during a display operation in the display panel of FIG. 2A, and FIG. 8 is a diagram illustrating still another example of driving pixels that are driven during a display operation in the display panel of FIG. 2A.

Referring to FIGS. 6 to 8, the transparent display region UPR may be surrounded by the intermediate display region MID, and the intermediate display region MID may be surrounded by the non-transparent display region NOR. In this case, the transparent display region UPR and the intermediate display region MID may have the same shape, and the center of the transparent display region UPR may coincide with the center of the intermediate display region MID.

Referring to FIG. 6, when the transparent display region UPR has a circular shape, the intermediate display region MID may also have a circular shape, and the driving pixel density of the intermediate display region MID may gradually increase from the transparent display region UPR to the non-transparent display region NOR. In one embodiment, as shown in FIG. 6, during the display operation of the display panel 100, some of the third pixels driven in the intermediate display region MID (i.e., the driving pixels) may be selected symmetrically with respect to the horizontal axis and the vertical axis passing through the center of the transparent display region UPR. In another embodiment, during the display operation of the display panel 100, some of the third pixels driven in the intermediate display region MID may be selected asymmetrically with respect to the horizontal axis or the vertical axis passing through the center of the transparent display region UPR. Referring to FIG. 7, when the transparent display region UPR has a square shape, the intermediate display region MID may also have a square shape, and the driving pixel density of the intermediate display region MID may gradually increase from the transparent display region UPR to the non-transparent display region NOR. In one embodiment, as shown in FIG. 7, during the display operation of the display panel 100, some of the third pixels driven in the intermediate display region MID (i.e., the driving pixels) may be selected symmetrically with respect to the horizontal axis and the vertical axis passing through the center of the transparent display region UPR. In another embodiment, during the display operation of the display panel 100, some of the third pixels driven in the intermediate display region MID may be selected asymmetrically with respect to the horizontal axis or the vertical axis passing through the center of the transparent display region UPR. Referring to FIG. 8, when the transparent display region UPR has a diamond (or rhombic) shape, the intermediate display region MID may also have a diamond shape, and the driving pixel density of the intermediate display region MID may gradually increase from the transparent display region UPR to the non-transparent display region NOR. In one embodiment, as shown in FIG. 8, during the display operation of the display panel 100, some of the third pixels driven in the intermediate display region MID (i.e., the driving pixels) may be selected symmetrically with respect to the horizontal axis and the vertical axis passing through the center of the transparent display region UPR. In another embodiment, during the display operation of the display panel 100, some of the third pixels driven in the intermediate display region MID may be selected asymmetrically with respect to the horizontal axis or the vertical axis passing through the center of the transparent display region UPR.

Figure 9:
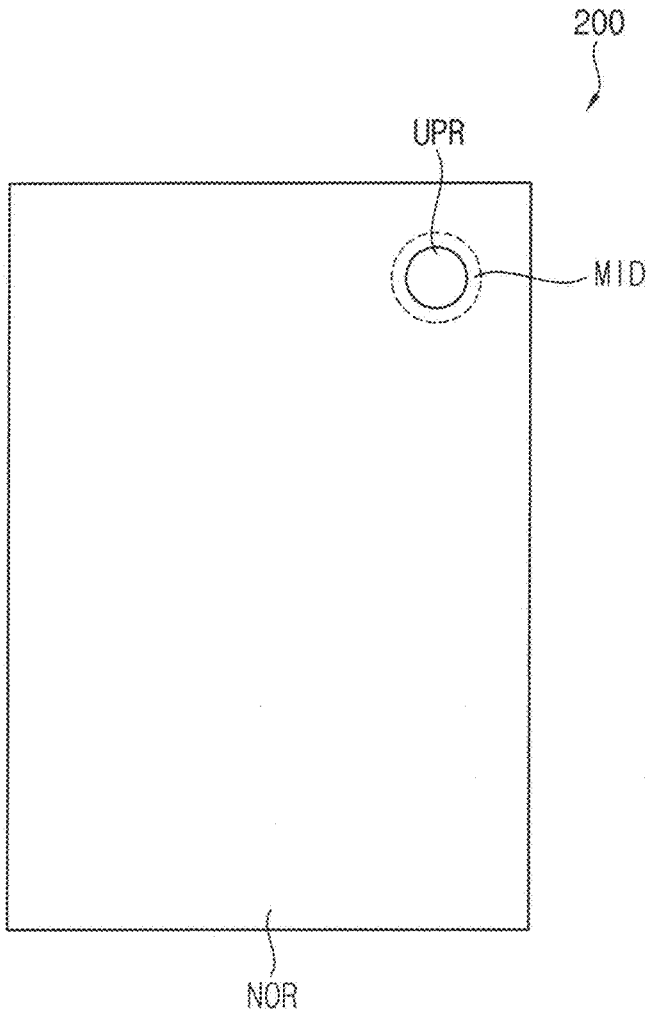
FIG. 9 is a diagram illustrating a display panel according to embodiments.
Figure 10:
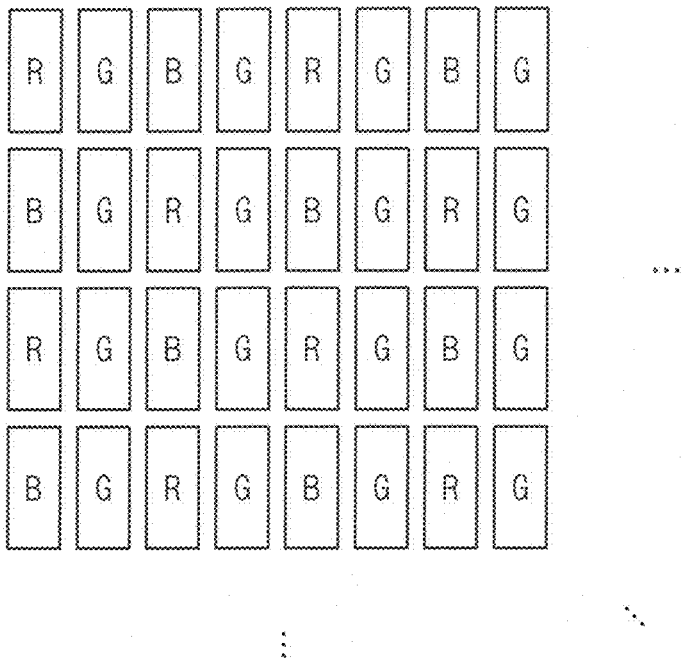
FIG. 10 is a diagram illustrating an example of a structure of a non-transparent display region included in the display panel of FIG. 9.
Figure 11:
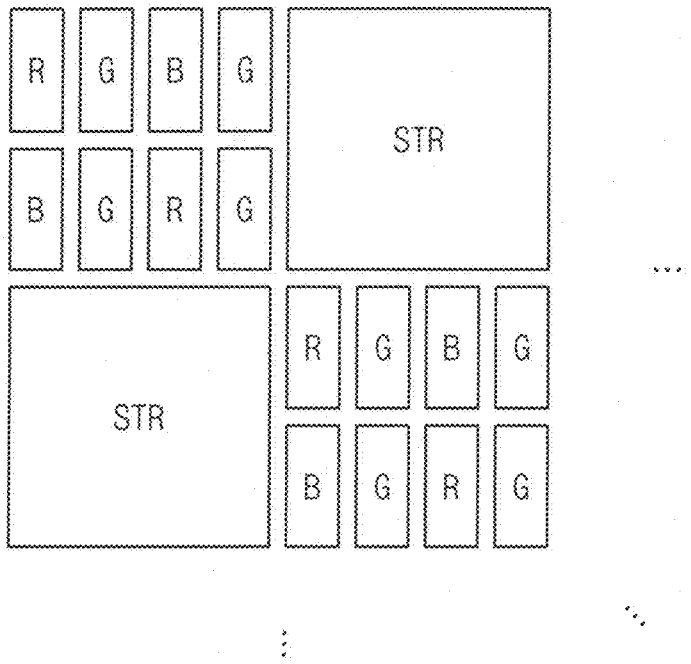
FIG. 11 is a diagram illustrating an example of a structure of an intermediate display region included in the display panel of FIG. 9.
Figure 12:
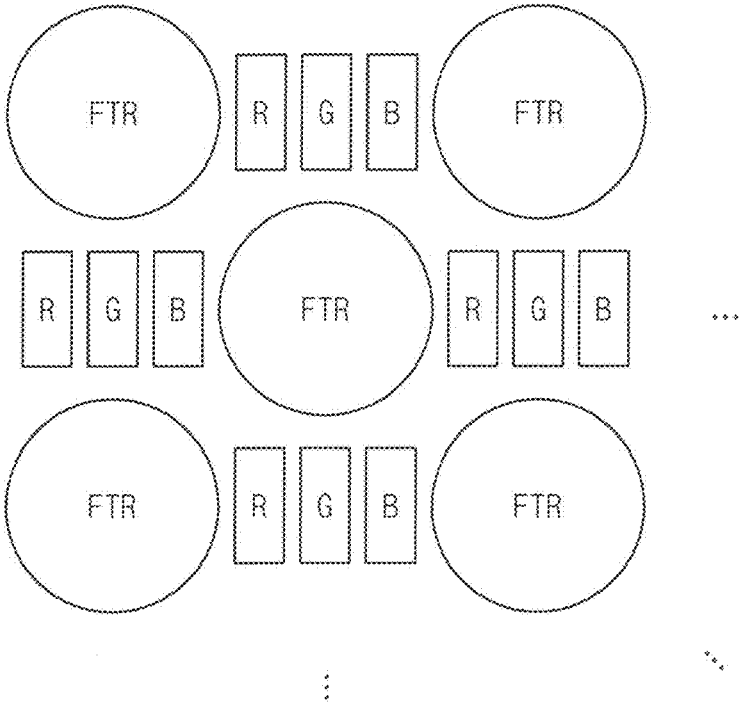
FIG. 12 is a diagram illustrating an example of a structure of a transparent display region included in the display panel of FIG. 9.
Figure 13A:
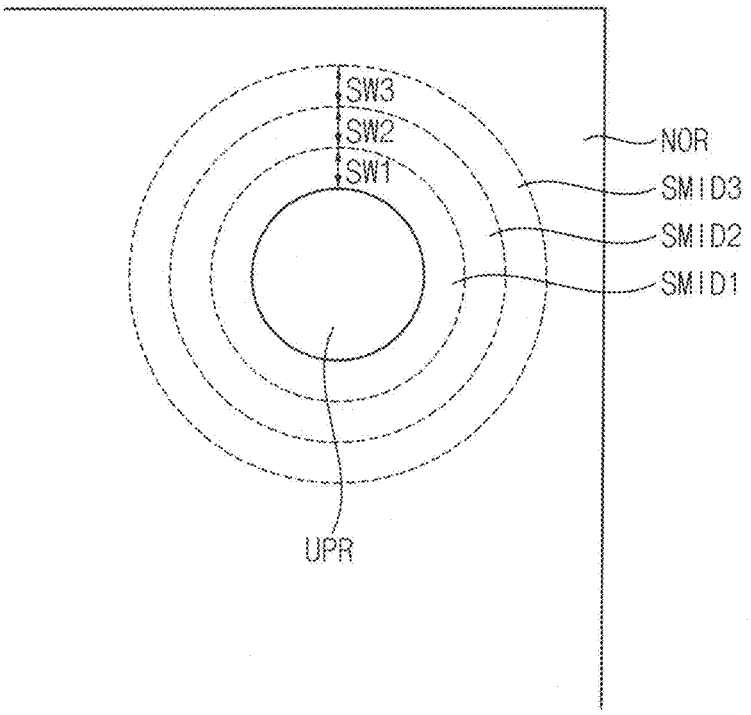
FIGS. 13A and 13B are diagrams for describing a layout in which first to third pixels are arranged in the display panel of FIG. 9.
Figure 13B:
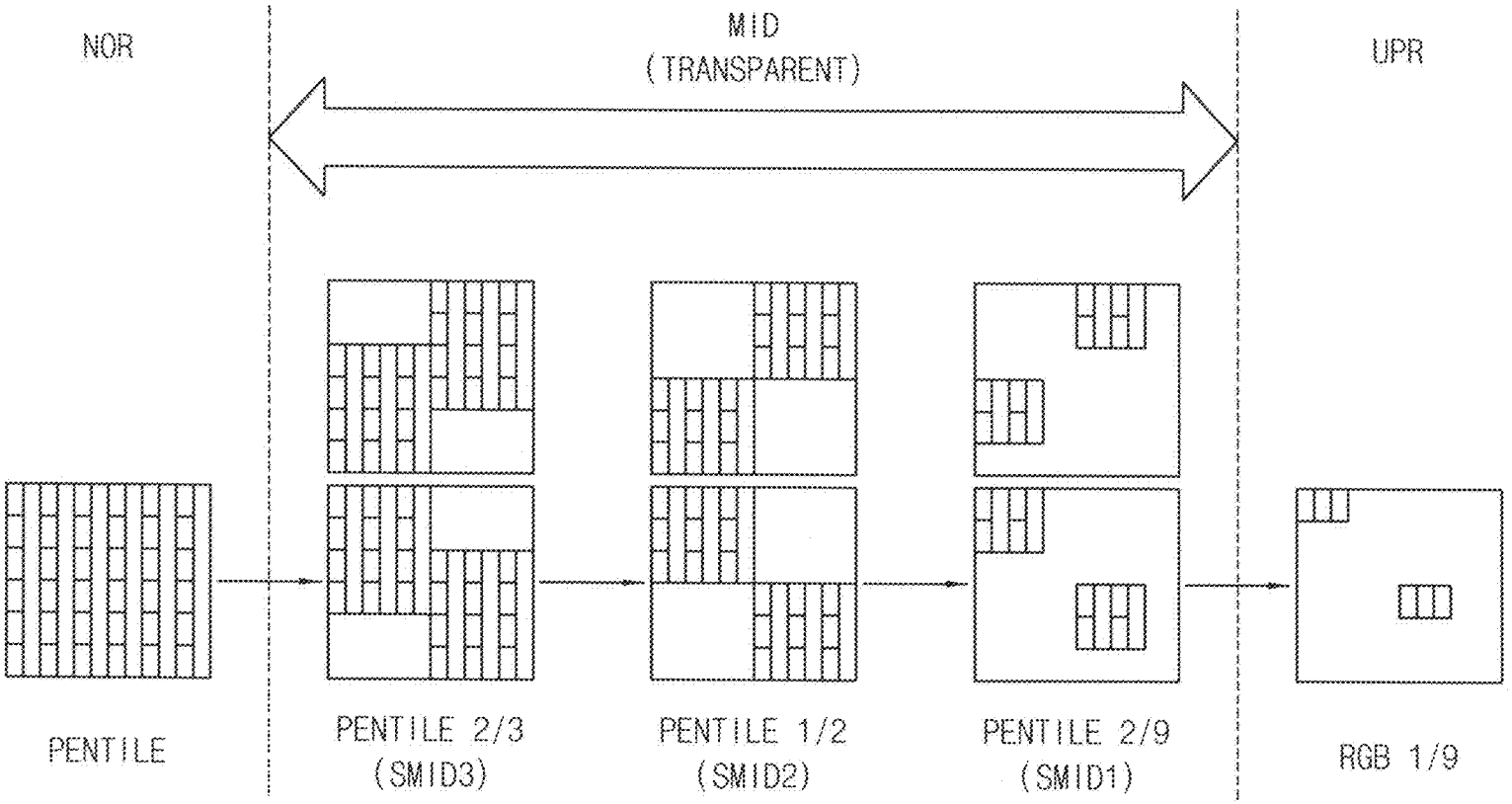

FIG. 9 is a diagram illustrating a display panel according to embodiments, FIG. 10 is a diagram illustrating an example of a structure of a non-transparent display region included in the display panel of FIG. 9, FIG. 11 is a diagram illustrating an example of a structure of an intermediate display region included in the display panel of FIG. 9, FIG. 12 is a diagram illustrating an example of a structure of a transparent display region included in the display panel of FIG. 9, and FIGS. 13A and 13B are diagrams for describing a layout in which first to third pixels are arranged in the display panel of FIG. 9.

Referring to FIGS. 9 to 13B, a display panel 200 may include a transparent display region UPR (or referred to as a first display region), a non-transparent display region NOR (or referred to as a second display region), and an intermediate display region MID (or referred to as a third display region) disposed between the transparent display region UPR and the non-transparent display region NOR.

The transparent display region UPR under which an optical module is located may include first transparent regions FTR. Light for an operation of the optical module may pass through the first transparent regions FTR. For example, the optical module may include: a proximity sensor module for detecting proximity of a predetermined object with respect to a front surface of the display panel 200; an illuminance sensor module for detecting illuminance on the front surface of the display panel 200; an iris recognition sensor module for recognizing an iris of a user; a camera module for capturing a still image and/or a moving image; and the like. First pixels having a first pixel structure may be disposed between the first transparent regions FTR in the transparent display region UPR. For example, as shown in FIG. 12, the first pixels disposed in the transparent display region UPR may have an RGB structure. For example, each of the first pixels may include a red sub-pixel R, a green sub-pixel G, and a blue sub-pixel B. Since the optical module is disposed under the transparent display region UPR to overlap the transparent display region UPR, the light for the operation of the optical module may pass through the transparent display region UPR. To this end, as shown in FIG. 12, the transparent display region UPR may include first transparent regions FTR and first pixels disposed which are disposed alternatingly along a first direction and a second direction which is perpendicular to the first direction. Although the first transparent region FTR has been shown in FIG. 12 as having a circular shape, the above shape is proposed for illustrative purposes, and the first transparent region FTR may have various shapes (e.g., a rectangular shape). As described above, since the transparent display region UPR includes the first transparent regions FTR, the transparent display region UPR may have a lower pixel density than the non-transparent display region NOR that does not include transparent regions. In some embodiments, in order to relatively increase emission luminance of each of the first pixels included in the transparent display region UPR, a size of each of the first pixels included in the transparent display region UPR may be formed to have a size larger than a size of each of second pixels included in the non-transparent display region NOR and/or a size of each of the third pixels included in the intermediate display region MID.

Second pixels having a second pixel structure may be disposed in the non-transparent display region NOR. For example, as shown in FIG. 10, the second pixels disposed in the non-transparent display region NOR may have a PenTile structure. For example, each of the second pixels may include a red sub-pixel R and a green sub-pixel G, or a blue sub-pixel B and a green sub-pixel G. However, the above configuration is proposed for illustrative purposes, so the pixel structure is not limited thereto. As described above, since the non-transparent display region NOR does not include transparent regions through which the light for the operation of the optical module passes, the non-transparent display region NOR may have a higher pixel density than the transparent display region UPR including the first transparent regions FTR. As a result, under the same conditions (e.g., application of the same data voltage, etc.), luminance of the non-transparent display region NOR may be higher than luminance of the transparent display region UPR. Accordingly, when the intermediate display region MID does not exist, a boundary between the non-transparent display region NOR and the transparent display region UPR may be recognized by a user due to a difference in luminance between the non-transparent display region NOR and the transparent display region UPR.

The intermediate display region MID may be disposed between the transparent display region UPR and the non-transparent display region NOR. The intermediate display region MID may include second transparent regions STR in which the optical module is disposed under the second transparent regions STR to overlap the transparent display region UPR. Light for the operation of the optical module may pass through the second transparent regions STR. Third pixels having a third pixel structure may be disposed between the second transparent regions STR in the intermediate display region MID. In one embodiment, the first pixel structure, the second pixel structure, and the third pixel structure may be identical to each other. In another embodiment, at least one of the first pixel structure, the second pixel structure, and the third pixel structure may be different from the others. For example, as shown in FIG. 11, the third pixels disposed in the intermediate display region MID may have a PenTile structure. For example, each of the third pixels may include a red sub-pixel R and a green sub-pixel G, or a blue sub-pixel B and a green sub-pixel G. However, the above configuration is proposed for illustrative purposes, so the pixel structure is not limited thereto. The optical module may also be disposed under the intermediate display region MID to overlap the intermediate display region MID. Accordingly, the light for the operation of the optical module may also pass through the intermediate display region MID. To this end, as shown in FIG. 11, the intermediate display region MID may include second transparent regions STR and the third pixels. Although the second transparent region STR has been shown in FIG. 11 as having a rectangular shape, the above shape is proposed for illustrative purposes, and the second transparent region STR may have various shapes (e.g., a circular shape). As described above, since the intermediate display region MID includes the second transparent regions STR, the intermediate display region MID may have a lower pixel density than the non-transparent display region NOR that does not include the second transparent regions STR.

The display panel 200 may have a structure in which a pixel density of the intermediate display region MID gradually increases from the transparent display region UPR to the non-transparent display region NOR. In this case, the pixel density of the intermediate display region MID may be determined according to the number and/or an area of the second transparent regions STR disposed in the intermediate display region MID. In one embodiment, as shown in FIG. 9, the transparent display region UPR may be surrounded by the intermediate display region MID, and the intermediate display region MID may be surrounded by the non-transparent display region NOR. In this case, the intermediate display region MID and the transparent display region UPR may have the same shape. For example, as shown in FIG. 9, when the transparent display region UPR has a circular shape, the intermediate display region MID surrounding the transparent display region UPR may also have a circular shape. As another example, when the transparent display region UPR has a square shape, the intermediate display region MID surrounding the transparent display region UPR may also have a square shape. As still another example, when the transparent display region UPR has a diamond shape, the intermediate display region MID surrounding the transparent display region UPR may also have a diamond shape. In some embodiments, the transparent display region UPR, the intermediate display region MID, and the non-transparent display region NOR may be sequentially arranged in one direction. However, for convenience of description, in the present disclosure, the following description will focus on an embodiment in which the transparent display region UPR is surrounded by the intermediate display region MID, and the intermediate display region MID is surrounded by the non-transparent display region NOR.

As described above, the pixel density of the intermediate display region MID may gradually increase from the transparent display region UPR to the non-transparent display region NOR. In this case, the pixel density may be defined as number of pixels per unit area. In detail, the intermediate display region MID may include first to $k^{th}$ sub-intermediate display regions SMID1, . . . , and SMIDk, where k is an integer greater than or equal to 2, the first sub-intermediate display region SMID1 may be disposed adjacent to the transparent display region UPR, the $k^{th}$ sub-intermediate display region SMIDk may be disposed adjacent to the non-transparent display region NOR, and a pixel density of an $m^{th}$ sub-intermediate display region SMIDm may be lower than a pixel density of an $(m+1)^{th}$ sub-intermediate display region SMIDm+1, where m is an integer greater than or equal to 1 and smaller than k. For example, the first to $k^{th}$ sub-intermediate display regions SMID1, . . . , and SMIDk may have the same driving pixel density, but may have mutually different pixel densities. In one embodiment, as shown in FIG. 13A, the first to $k^{th}$ sub-intermediate display regions SMID1, . . . , and SMIDk may have the same widths SW1, SW2, and SW3. In another embodiment, two or more of the first to $k^{th}$ sub-intermediate display regions SMID1, . . . , and SMIDk may have mutually different widths SW1, SW2, and SW3. For example, as shown in FIG. 13A, when the intermediate display region MID includes first to third sub-intermediate display regions SMID1, SMID2, and SMID3, the first sub-intermediate display region SMID1 may be disposed adjacent to the transparent display region UPR, and the third sub-intermediate display region SMID3 may be disposed adjacent to the non-transparent display region NOR. In this case, as shown in FIG. 13B, a pixel density of the first sub-intermediate display region SMID1 may be lower than a pixel density of the second sub-intermediate display region SMID2, and the pixel density of the second sub-intermediate display region SMID2 may be lower than a pixel density of the third sub-intermediate display region SMID3. In other words, the pixel density of the intermediate display region MID may gradually increase from the transparent display region UPR to the non-transparent display region NOR.

For example, as shown in FIG. 13B, since the transparent display region UPR is a central portion through which the light for the operation of the optical module passes, the transparent display region UPR may have the lowest pixel density (e.g., the transparent display region UPR may have a pixel density of ⅙). Meanwhile, since the intermediate display region MID is a peripheral portion through which the light for the operation of the optical module passes, the pixel density of the intermediate display region MID may be greater than a pixel density of the transparent display region UPR. Therefore, the pixel density of the first sub-intermediate display region SMID1 surrounding the transparent display region UPR may be higher than the pixel density of the transparent display region UPR (e.g., the first sub-intermediate display region SMID1 may have a pixel density of ⅔). In addition, since the pixel density of the intermediate display region MID gradually increases from the transparent display region UPR to the non-transparent display region NOR, the pixel density of the second sub-intermediate display region SMID2 surrounding the first sub-intermediate display region SMID1 may be higher than the pixel density of the first sub-intermediate display region SMID1 (e.g., the second sub-intermediate display region SMID2 may have a pixel density of ½). Furthermore, since the pixel density of the intermediate display region MID gradually increases from the transparent display region UPR to the non-transparent display region NOR, the pixel density of the third sub-intermediate display region SMID3 surrounding the second sub-intermediate display region SMID2 may be higher than the pixel density of the second sub-intermediate display region SMID2 (e.g., the third sub-intermediate display region SMID3 may have a pixel density of ⅔). Meanwhile, since the non-transparent display region NOR is a region configured to perform image display only, a pixel density of the non-transparent display region NOR surrounding the third sub-intermediate display region SMID3 may be higher than the pixel density of the third sub-intermediate display region SMID3 (e.g., the non-transparent display region NOR may have a pixel density of 1/1). However, the above configuration is proposed for illustrative purposes, so the pixel structure according to the present invention is not limited thereto.

In one embodiment, the third pixels in the intermediate display region MID may be disposed symmetrically with respect to a horizontal axis and a vertical axis passing through a center of the transparent display region UPR. Because the intermediate display region MID surrounds the transparent display region UPR, a center of the intermediate display region MID may coincide with the center of the transparent display region UPR. Because the third pixels in the intermediate display region MID are disposed symmetrically with respect to the horizontal axis and the vertical axis passing through the center of the intermediate display region MID, an image displayed in the intermediate display region MID may be prevented from being asymmetrically viewed. In another embodiment, the third pixels in the intermediate display region MID may be disposed asymmetrically with respect to the horizontal axis or the vertical axis passing through the center of the transparent display region UPR. As described above, since the intermediate display region MID surrounds the transparent display region UPR, the center of the intermediate display region MID may coincide with the center of the transparent display region UPR. In this case, since the third pixels in the intermediate display region MID are disposed asymmetrically with respect to the horizontal axis or the vertical axis passing through the center of the intermediate display region MID, an image displayed in the intermediate display region MID may be asymmetrically viewed, but image quality may be improved in a specific image pattern.

As described above, the display panel 200 may include: a transparent display region UPR in which an optical module is disposed under the transparent display region UPR to overlap the transparent display region UPR, the transparent display region UPR includes first transparent regions FTR through which light for an operation of the optical module passes, and first pixels having a first pixel structure are disposed between the first transparent regions FTR; a non-transparent display region NOR in which second pixels having a second pixel structure are disposed; and an intermediate display region MID located between the transparent display region UPR and the non-transparent display region NOR, in which the optical module is disposed under the intermediate display region MID to overlap the intermediate display region MID, the intermediate display region MID includes second transparent regions STR through which the light passes, and third pixels having a third pixel structure are disposed between the second transparent regions STR (where the intermediate display region MID actually corresponds to the transparent display region UPR because the intermediate display region MID includes the second transparent regions STR). In this case, the display panel 200 has the pixel structure in which the pixel density of the intermediate display region MID gradually increases from the transparent display region UPR to the non-transparent display region NOR so that user recognition of the boundary between the non-transparent display region NOR and the transparent display region UPR may be minimized through the gradual design structure while the display panel 200 operates in a manner that does not cause deterioration of the first pixels included in the transparent display region UPR (i.e., it is unnecessary to perform the driving for intentionally increasing luminance of each of the first pixels included in the transparent display region UPR). Meanwhile, although the above description has been focusing on the embodiment in which the transparent display region UPR is surrounded by the intermediate display region MID, and the intermediate display region MID is surrounded by the non-transparent display region NOR, it should be understood that the present invention is not limited to the above embodiment. For example, the present invention may be applied to an embodiment in which the transparent display region UPR, the intermediate display region MID, and the non-transparent display region NOR are sequentially arranged in one direction. In addition, although the display panel 200 has been described above as having the pixel structure in which the pixel density of the intermediate display region MID gradually increases from the transparent display region UPR to the non-transparent display region NOR, in some embodiments, the display panel 200 may have a pixel structure in which a transmittance per unit area of the intermediate display region MID gradually increases from the non-transparent display region NOR to the transparent display region UPR. In this case, the transmittance per unit area of the intermediate display region MID may be determined according to the number and/or an area of the second transparent regions STR, or may be determined according to transmittance of a material constituting the third pixels.

Figure 14:
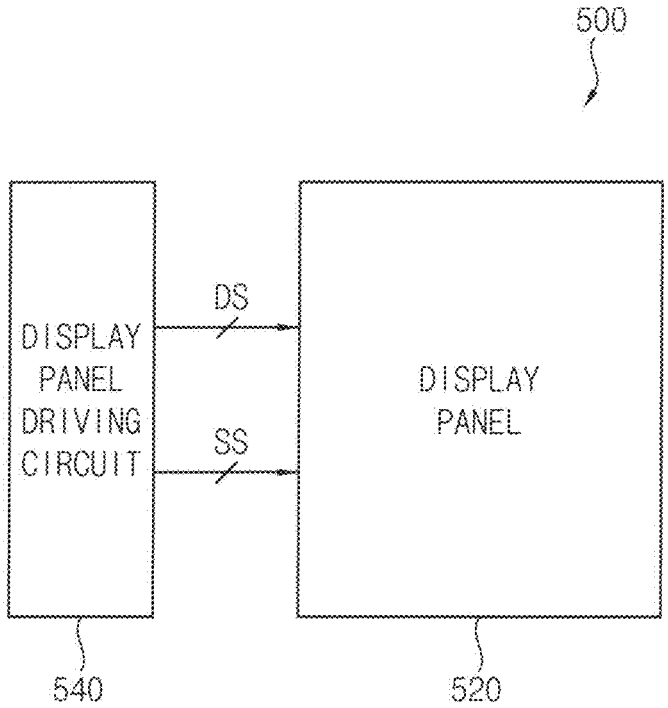
FIG. 14 is a block diagram illustrating a display device according to embodiments.

FIG. 14 is a block diagram illustrating a display device according to embodiments.

Referring to FIG. 14, the display device 500 may include a display panel 520 and a display panel driving circuit 540. In some embodiments, the display device 500 may be an organic light emitting display device. However, the display device 500 is not limited thereto.

A display panel 520 may include a plurality of pixels. A display panel driving circuit 540 may drive the display panel 520. In this case, the display panel driving circuit 540 may include a data driver, a scan driver, a timing controller, and the like. The display panel 520 may be connected to the data driver through data lines, and may be connected to the scan driver through scan lines. The data driver may provide a data signal DS to the display panel 520 through the data lines. In other words, the data driver may provide the data signal DS to the pixels included in the display panel 520. The scan driver may provide a scan signal SS to the display panel 520 through the scan lines. In other words, the scan driver may provide the scan signal SS to the pixels included in the display panel 520. The timing controller may generate a plurality of control signals and provide the control signals to the data driver and the scan driver so as to control the data driver and the scan driver. In some embodiments, the timing controller may perform predetermined processing (e.g., data compensation processing, etc.) on data input from outside.

Meanwhile, the display panel 520 may include a transparent display region, a non-transparent display region, and an intermediate display region located between the transparent display region and the non-transparent display region. In one embodiment, the display panel 520 may include: a transparent display region in which an optical module is disposed under the transparent display region to overlap the transparent display region, the transparent display region includes transparent regions through which light for an operation of the optical module passes, and first pixels having a first pixel structure are disposed between the transparent regions; a non-transparent display region in which second pixels having a second pixel structure are disposed; and an intermediate display region located between the transparent display region and the non-transparent display region, in which third pixels having a third pixel structure are disposed, wherein, while driving only part of the third pixels included in the intermediate display region during a display operation, gradual driving masking in which a driving pixel density of the intermediate display region gradually increases from the transparent display region to the non-transparent display region may be performed.

In another embodiment, the display panel 520 may include: a transparent display region in which an optical module is disposed under the transparent display region to overlap the transparent display region, the transparent display region includes first transparent regions through which light for an operation of the optical module passes, and first pixels having a first pixel structure are disposed between the first transparent regions; a non-transparent display region in which second pixels having a second pixel structure are disposed; and an intermediate display region located between the transparent display region and the non-transparent display region, in which the optical module is disposed under the intermediate display region to overlap the intermediate display region, the intermediate display region includes second transparent regions through which the light passes, and third pixels having a third pixel structure are disposed between the second transparent regions, wherein the display panel 520 may have a pixel structure in which a pixel density of the intermediate display region gradually increases from the transparent display region to the non-transparent display region. Therefore, user may not recognize a boundary between the non-transparent display region and the transparent display region even when the display panel 520 is operated in a manner that does not cause deterioration of the first pixels included in the transparent display region (i.e., it is unnecessary to perform the driving for intentionally increasing luminance of each of the first pixels included in the transparent display region). As a result, the display device 500 including the display panel 520 may provide a high-quality image to a user.

Figure 15:
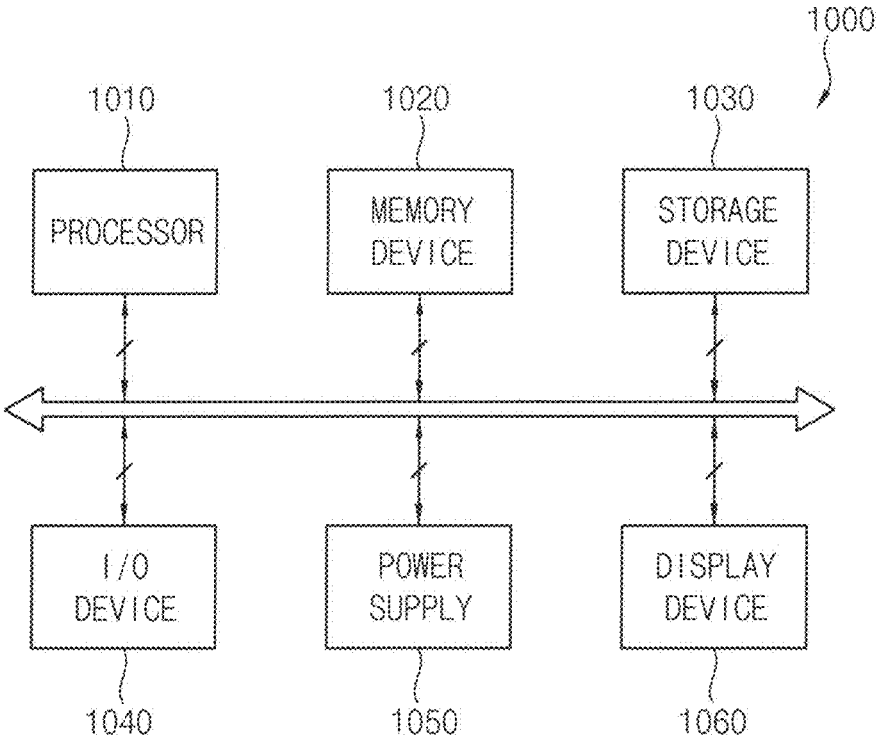
FIG. 15 is a block diagram illustrating an electronic device according to embodiments.
Figure 16:
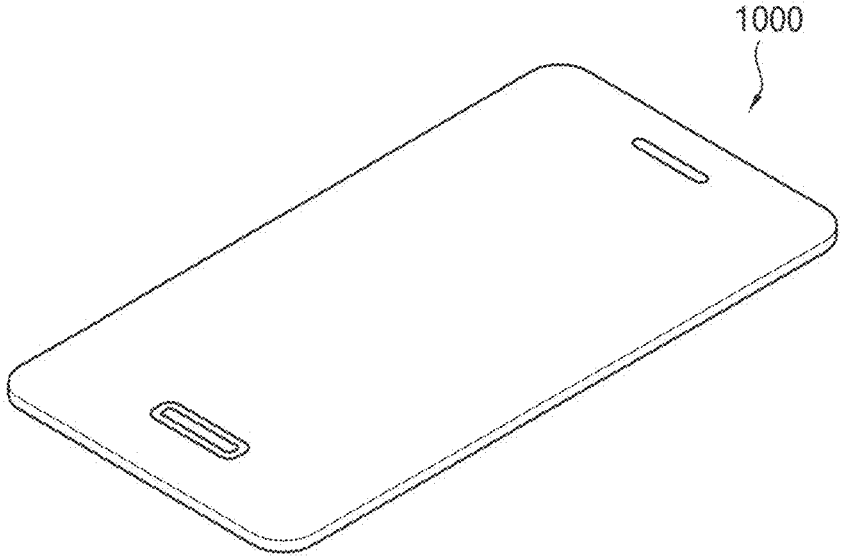
FIG. 16 is a diagram illustrating an example in which the electronic device of FIG. 15 is implemented as a smart phone.

FIG. 15 is a block diagram illustrating an electronic device according to embodiments, and FIG. 16 is a diagram illustrating an example in which the electronic device of FIG. 15 is implemented as a smart phone.

Referring to FIGS. 15 and 16, the electronic device 1000 may include a processor 1010, a memory device 1020, a storage device 1030, an input/output (I/O) device 1040, a power supply 1050, and a display device 1060. Here, the display device 1060 may be the display device 500 of FIG. 14. In addition, the electronic device 1000 may further include a plurality of ports for communicating with a video card, a sound card, a memory card, a universal serial bus (USB) device, other electronic devices, etc. In an embodiment, as illustrated in FIG. 16, the electronic device 1000 may be implemented as a smart phone. However, the electronic device 1000 is not limited thereto. For example, the electronic device 1000 may be implemented as a cellular phone, a video phone, a smart pad, a smart watch, a tablet PC, a car navigation system, a computer monitor, a laptop, a head mounted display (HMD) device, and the like.

The processor 1010 may perform various computing functions. The processor 1010 may be a micro-processor, a central processing unit (CPU), an application processor (AP), and the like. The processor 1010 may be coupled to other components via an address bus, a control bus, a data bus, etc. Further, the processor 1010 may be coupled to an extended bus such as a peripheral component interconnection (PCI) bus. The memory device 1020 may store data for operations of the electronic device 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, and the like and/or at least one volatile memory device such as a dynamic random access memory (DRAM) device, a static random access memory (SRAM) device, a mobile DRAM device, and the like. The storage device 1030 may include a solid state drive (SSD) device, a hard disk drive (HDD) device, a CD-ROM device, and the like. The I/O device 1040 may include an input device such as a keyboard, a keypad, a mouse device, a touch-pad, a touch-screen, and the like and an output device such as a printer, a speaker, and the like. In some embodiments, the display device 1060 may be included in the I/O device 1040. The power supply 1050 may provide power for operations of the electronic device 1000. The display device 1060 may be coupled to other components via the buses or other communication links.

The display device 1060 may display an image corresponding to visual information of the electronic device 1000. To this end, the display device 1060 may include a display panel including a plurality of pixels, and a display panel driving circuit configured to drive the display panel. In this case, user recognition of a boundary between a non-transparent display region and a transparent display region may be minimized while the display panel included in the display device 1060 operates in a manner that does not cause deterioration of first pixels included in the transparent display region. In one embodiment, the display panel included in the display device 1060 may include: a transparent display region in which an optical module is disposed under the transparent display region to overlap the transparent display region, the transparent display region includes transparent regions through which light for an operation of the optical module passes, and first pixels having a first pixel structure are disposed between the transparent regions; a non-transparent display region in which second pixels having a second pixel structure are disposed; and an intermediate display region located between the transparent display region and the non-transparent display region, in which third pixels having a third pixel structure are disposed, wherein, while driving only part of the third pixels included in the intermediate display region during a display operation, gradual driving masking in which a driving pixel density of the intermediate display region gradually increases from the transparent display region to the non-transparent display region may be performed. In another embodiment, the display panel included in the display device 1060 may include: a transparent display region in which an optical module is disposed under the transparent display region to overlap the transparent display region, the transparent display region includes first transparent regions through which light for an operation of the optical module passes, and first pixels having a first pixel structure are disposed between the first transparent regions; a non-transparent display region in which second pixels having a second pixel structure are disposed; and an intermediate display region located between the transparent display region and the non-transparent display region, in which the optical module is disposed under the intermediate display region to overlap the intermediate display region, the intermediate display region includes second transparent regions through which the light passes, and third pixels having a third pixel structure are disposed between the second transparent regions, wherein the display panel may have a pixel structure in which a pixel density of the intermediate display region gradually increases from the transparent display region to the non-transparent display region. Since these are described above, duplicated description related thereto will not be repeated.

The present inventive concept may be applied to a display device and an electronic device including the display device. For example, the present inventive concept may be applied to a smart phone, a cellular phone, a video phone, a smart pad, a smart watch, a tablet PC, a car navigation system, a television, a computer monitor, a laptop, a head mounted display (HMD) device, an MP3 player, and the like.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A display device comprising:

a display panel; and an optical module disposed under the display panel, wherein the display panel includes:

a first display region under which the optical module is disposed to overlap the first display region in a plan view, the first display region including transparent regions through which light for an operation of the optical module passes and first pixels having a first pixel structure and disposed between the transparent regions;

a second display region in which second pixels having a second pixel structure are disposed; and a third display region disposed between the first display region and the second display region, third pixels having a third pixel structure being disposed in the third display region, only part of the third pixels being driven during a display operation, and wherein the part of the third pixels driven in the third display region during the display operation are altered every frame.

2. The display device of claim 1, wherein the first pixel structure, the second pixel structure, and the third pixel structure are identical to each other.

3. The display device of claim 1, wherein one of the first pixel structure, the second pixel structure, and the third pixel structure is different from the others.

4. The display device of claim 3, wherein the first pixel structure is an RGB structure, and each of the second pixel structure and the third pixel structure is a PenTile structure.

5. The display device of claim 1, wherein the first display region is surrounded by the third display region, and the third display region is surrounded by the second display region.

6. The display device of claim 1, wherein the third display region includes first to kth sub-intermediate display regions, where k is an integer greater than or equal to 2, the first sub-intermediate display region is disposed adjacent to the first display region, the kth sub-intermediate display region is disposed adjacent to the second display region, and a driving pixel density of an mth sub-intermediate display region is lower than a driving pixel density of an (m+1)th sub-intermediate display region during the display operation, where m is an integer greater than or equal to 1 and smaller than k.

7. The display device of claim 6, wherein the part of the third pixels driven in the third display region during the display operation are selected symmetrically with respect to a horizontal axis and a vertical axis passing through a center of the first display region.

8. The display device of claim 6, wherein the part of the third pixels driven in the third display region during the display operation are selected asymmetrically with respect to a horizontal axis or a vertical axis passing through a center of the first display region.

9. The display device of claim 6, wherein the part of the third pixels driven in the third display region during the display operation are selected in a preset fixed pattern.

10. The display device of claim 6, wherein the first to kth sub-intermediate display regions have a same width.

11. The display device of claim 6, wherein at least one of the first to kth sub-intermediate display regions has a different width than the other intermediate display regions.

12. A display device comprising:

a display panel; and an optical module disposed under the display panel, wherein the display panel includes:

a first display region under which the optical module is disposed to overlap the first display region in a plan view, the first display region including first transparent regions through which light for an operation of the optical module passes and first pixels having a first pixel structure and disposed between the first transparent regions;

a second display region in which second pixels having a second pixel structure are disposed; and a third display region disposed between the first display region and the second display region, the optical module being disposed under the third display region to overlap the third display region in a plan view, the third display region including second transparent regions through which the light passes and third pixels having a third pixel structure and disposed between the second transparent regions.

13. The display device of claim 12, wherein the first pixel structure, the second pixel structure, and the third pixel structure are identical to each other.

14. The display device of claim 12, wherein one of the first pixel structure, the second pixel structure, and the third pixel structure are different from the others.

15. The display device of claim 14, wherein the first pixel structure is an RGB structure, and each of the second pixel structure and the third pixel structure is a PenTile structure.

16. The display device of claim 12, wherein the first display region is surrounded by the third display region and the third display region is surrounded by the second display region.

17. The display device of claim 12, wherein the third display region includes first to kth sub-intermediate display regions, where k is an integer greater than or equal to 2, the first sub-intermediate display region is disposed adjacent to the first display region, the kth sub-intermediate display region is disposed adjacent to the second display region, and a pixel density of an mth sub-intermediate display region is lower than a pixel density of an (m+1)th sub-intermediate display region, where m is an integer greater than or equal to 1 and smaller than k.

18. The display device of claim 17, wherein the third pixels in the third display region are disposed symmetrically with respect to a horizontal axis and a vertical axis passing through a center of the first display region.

19. The display device of claim 17, wherein the third pixels in the third display region are disposed asymmetrically with respect to a horizontal axis or a vertical axis passing through a center of the first display region.

20. The display device of claim 17, wherein the first to kth sub-intermediate display regions have a same width.

21. The display device of claim 17, wherein at least one of the first to kth sub-intermediate display regions has a different width than the other intermediate display regions.

22. A display panel comprising:

a transparent display region including pixels disposed between adjacent first transparent areas;

an intermediate display region surrounding the transparent display region and including pixels disposed between adjacent second transparent areas; and a non-transparent display region surrounding the intermediate display region, wherein an area ratio of the second transparent areas in the intermediate display region is less than that of the first transparent areas in the transparent display region, and wherein the intermediate display region includes sub-intermediate display regions sequentially disposed between the transparent display region and the non-transparent display region and having different area ratios of the second transparent areas.

23. The display device of claim 22, wherein the sub-intermediate display region disposed adjacent to the transparent display region has an area ratio of the second transparent areas greater than that of the sub-intermediate display region disposed adjacent to the non-transparent display region.

24. The display device of claim 22, wherein an area of each of the first transparent areas is greater than an area of each of the second transparent areas.

25. The display device of claim 22, wherein the transparent display region has a different pixel structure than the intermediated display region and the non-transparent display region.

26. The display device of claim 22, wherein the transparent display region has an RGB structure and the intermediated display region and the non-transparent display region have a PenTile structure.

* * * * *